US011691442B2

(12) United States Patent
Hoshino

(10) Patent No.: US 11,691,442 B2
(45) **Date of Patent: *Jul. 4, 2023**

(54) LIQUID DISCHARGE APPARATUS

(71) Applicant: Ricoh Company, Ltd., Tokyo (JP)

(72) Inventor: Seiji Hoshino, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/829,381

(22) Filed: Jun. 1, 2022

(65) Prior Publication Data

US 2022/0288955 A1 Sep. 15, 2022

Related U.S. Application Data

(63) Continuation of application No. 17/036,097, filed on Sep. 29, 2020, now Pat. No. 11,376,873.

(30) Foreign Application Priority Data

Nov. 28, 2019 (JP) ..... 2019-215336

(51) Int. Cl.
*B41J 11/62* (2006.01)
*B41J 2/135* (2006.01)

(52) U.S. Cl.
CPC ..... *B41J 11/62* (2013.01); *B41J 2/135* (2013.01)

(58) Field of Classification Search
CPC ..... B41J 11/62; B41J 2/135
See application file for complete search history.

(56) References Cited

U.S. PATENT DOCUMENTS

| | | | |
|---|---|---|---|
| 6,000,784 | A | 12/1999 | Takemoto et al. |
| 6,627,015 | B1 | 9/2003 | Takemoto et al. |
| 2009/0207461 | A1 | 8/2009 | Hodoshima et al. |
| 2010/0245460 | A1 | 9/2010 | Imoto et al. |
| 2012/0249627 | A1 | 10/2012 | Komaba et al. |
| 2012/0262519 | A1 | 10/2012 | Hoshino et al. |
| 2019/0283069 | A1* | 9/2019 | Nakagaki ..... B41M 5/0017 |
| 2022/0048298 | A1 | 2/2022 | Sahun Peres et al. |

FOREIGN PATENT DOCUMENTS

| | | | |
|---|---|---|---|
| JP | 2007-313713 | A | 12/2007 |
| JP | 2009-45773 | A | 3/2009 |
| JP | 2009-292023 | A | 12/2009 |
| JP | 2010-280119 | A | 12/2010 |
| JP | 2014-33998 | A | 2/2014 |
| JP | 2017-77642 | A | 4/2017 |
| JP | 2018-94759 | A | 6/2018 |

OTHER PUBLICATIONS

Mimaki, "Precaution when printing in head gap more than 2 mm" Dear JF,JFX, JFX500, UJF-3042 Series, UJF-6042 and UJF-605R II series users, D201845-17-13122012, 1 page.

* cited by examiner

*Primary Examiner* — Thinh H Nguyen
(74) *Attorney, Agent, or Firm* — Xsensus LLP

(57) ABSTRACT

A liquid discharge apparatus includes a stage on which a recording medium is placed, a head configured to discharge a liquid onto the recording medium on the stage, an inclined wall adjacent to the recording medium, the inclined wall configured to cover a part of the stage, and a height adjuster configured to adjust a height of one end of the inclined wall to be equal to or lower than a thickness of the recording medium.

19 Claims, 14 Drawing Sheets

LIQUID DISCHARGE APPARATUS

CROSS-REFERENCE TO RELATED APPLICATIONS

This patent application is a continuation application of U.S. application Ser. No. 17/036,097, filed Sep. 29, 2020, which is based on and claims priority pursuant to 35 U.S.C. § 119(a) to Japanese Patent Application No. 2019-215336, filed on Nov. 28, 2019, in the Japan Patent Office, the entire disclosures of which is hereby incorporated by reference herein.

BACKGROUND

Technical Field

Aspects of this disclosure relate to a liquid discharge apparatus.

Related Art

Recently, an inkjet-type imaging process is used for imaging (printing) various types of media. Further, there is increasing demands for printing on a thick material. Hereinafter, the media is also referred to as a "recording medium."

Particularly, there is increasing demands for printing with a quick-drying inkjet process since the quick-drying inkjet process can directly print an image on thick materials such as plasterboard, panels, blocks, steel frames, and metal plates, onto which an image is difficult to be printed.

The recording media are overlaid immediately after the printing process in the printing process on the above-described recording media. Thus, the ink has to fix to the recording media immediately after the ink is discharged onto the recording media. As the inkjet-type imaging process, there is an "actinic-ray curing inkjet-system" in which curing is rapidly accelerated and fixed by irradiation with active rays in a specific wavelength range.

The "actinic-ray curing inkjet-system" discharges an actinic-ray curable ink onto the recording medium and then irradiates an image area in which the actinic-ray curable ink is discharged with the actinic-rays in the specific wavelength range. The "irradiator" is arranged near an inkjet discharge device to discharge the liquid (ink) droplets so that the ink droplet landed on a recording medium that forms an image is rapidly cured and fixed onto the recording medium. As such a printer, there is a so-called "Ultraviolet (UV) inkjet printer" as an image forming apparatus of an "actinic-ray irradiation-type inkjet-system."

SUMMARY

In an aspect of this disclosure, a liquid discharge apparatus is provided that includes a stage on which a recording medium is placed, a head configured to discharge a liquid onto the recording medium on the stage, an inclined wall adjacent to the recording medium, the inclined wall configured to cover a part of the stage, and a height adjuster configured to adjust a height of one end of the inclined wall to be equal to or lower than a thickness of the recording medium.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1A:
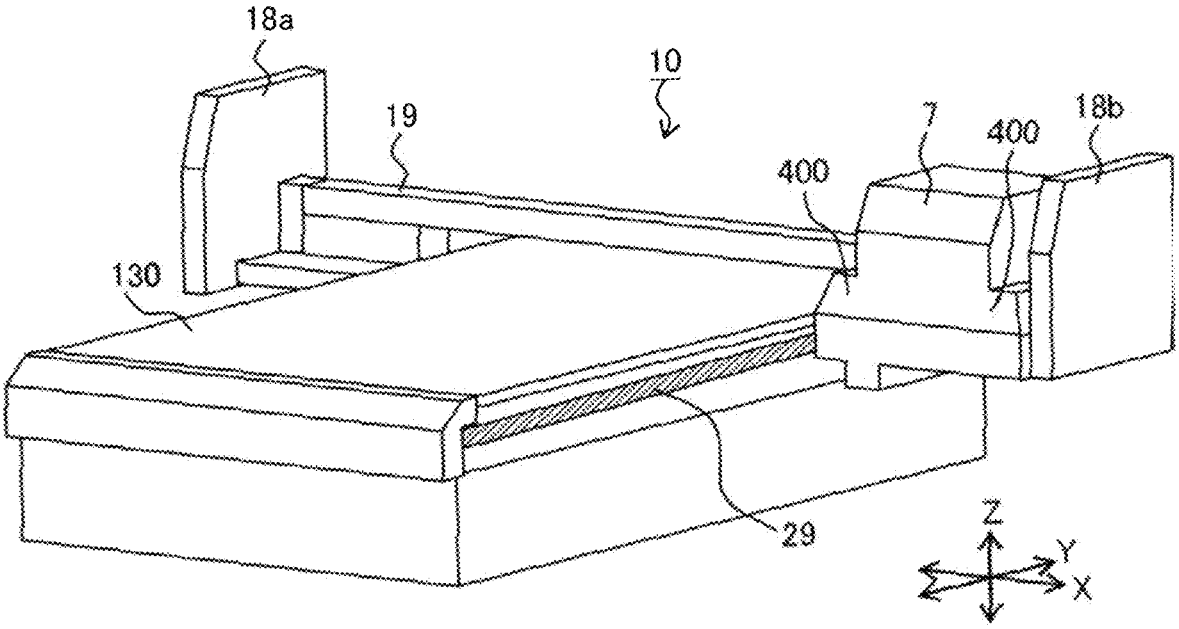
FIGS. 1A and 1B are schematic perspective views of an entire configuration of an inkjet recoding apparatus as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

A liquid discharge apparatus according to an embodiment of the present disclosure is described below with reference to the drawings. Note that the following embodiments are not limiting the present disclosure and any deletion, addition, modification, change, etc. can be made within a scope in which person skilled in the art can conceive including other embodiments, and any of which is included within the scope of the present disclosure as long as the effect and feature of the present disclosure are demonstrated.

An "UV inkjet-type" image forming apparatus serving as the liquid discharge apparatus discharges liquid (ink) droplets onto a recording medium to form an image on the recording medium and then irradiates an image area of the image on the recording medium with the ultraviolet (UV) rays. The liquid (ink) can be rapidly cured and fixed by an irradiation of the UV rays by a UV curing inkjet method. Hereinafter, the "UV inkjet-type image forming apparatus" is simply referred to as an "inkjet recording apparatus", and the inkjet recording apparatus is an example of the liquid discharge apparatus.

An "ultraviolet (UV) irradiator" is arranged near an inkjet discharge device so that the UV irradiator irradiates the image on the recording medium to rapidly cure and fix the image formed by the liquid (ink) droplets landed on the recording medium. There are generally many cases in the printing process using the UV inkjet-type image forming apparatus (inkjet recording apparatus) such that a thick recording medium is placed on a surface of a recording medium mounting table, and an image has to be formed on a marginal area of an end surface of the recording medium.

The ink discharge device of the inkjet recording apparatus includes a liquid discharge head to discharge liquid (ink) onto the recording medium immediately after the ink discharge device has moved and passed the end surface of the recording medium or immediately before the ink discharge device has moved and passed the end surface of the recording medium to form an image on an entire surface of the thick recording medium. Hereinafter, the "liquid discharge head" is simply referred to as a "head".

However, with increase in a thickness of the recording medium, air around a carriage or the recording medium is compressed due to a "main scanning movement" of the carriage. The compressed air generates a rapid pressure change at the end surface of the recording medium. The carriage mount a head that discharges the liquid and moves along a guide rod 19 (see FIGS. 1A and 1B) to move and scan the head in a main-scanning direction. The ink discharge device includes the carriage 7 and the head 1. The rapid pressure change generates a turbulent airflow.

Thus, the turbulent airflow hits a vertical portion on the end surface of the recording medium so that the turbulent airflow reaches the head as well. Thus, the trajectory of the liquid (ink) droplet is displaced in a direction different from an original (planed) direction that causes so-called a "landing position deviation" of the liquid (ink) droplet, or image distortion called a "print deviation." The above-described problem is a first problem.

To rapidly cure and fix the liquid (ink) droplets that have landed on the recording medium, the inkjet recording apparatus includes an ultraviolet (UV) light source that is installed on a downstream side in the main-scanning direction of the carriage that mounts the head. Thus, the ink droplets are instantly cured by the UV light emitted to an ink image forming surface of the recording medium immediately after landing of the liquid (ink) droplets.

However, due to the turbulent airflow generated by the first problem as described above, a part of the liquid (ink) droplets that should originally be landed on the recording medium at appropriate timings may float and become so-called "ink mist." The ink mist may be landed on a position deviated from the original (planed) image forming area. Further, the "ink mist" adheres to a light emitting surface of the UV light source to reduce irradiation light quantity of the UV light source. The above-described problem is a second problem.

A "dummy recording medium" or a "plate-shaped jig" may be found and installed in advance at a position adjacent to the end surface of the recording medium to prevent the ink mist. The dummy recording medium or the plate-shaped jig has an appropriate thickness that is approximately equal to the thickness of the recording medium.

However, it takes time to find and install the appropriate member for the dummy recording medium or the plate-shaped jig to the position adjacent to the end surface of the recording medium. The above-described problem is a third problem.

As described above, a particular problem may occur in the image forming apparatus using the inkjet-type method such that the landing position deviation (also referred to as "print deviation") of the liquid (ink) droplets occurs due to an influence of the turbulent airflow generated by a scanning movement of the carriage in the main scanning direction when an image is formed or fabricated on a thick recording medium. The above-described technologies aims to reduce print deviation.

Hereinafter, the inkjet recoding apparatus 11 that prints an image on a thick recording medium 101 is described with reference to the drawings as a comparative example. The inkjet recording apparatus 11 is an example of a liquid discharge apparatus.

Figure 12:
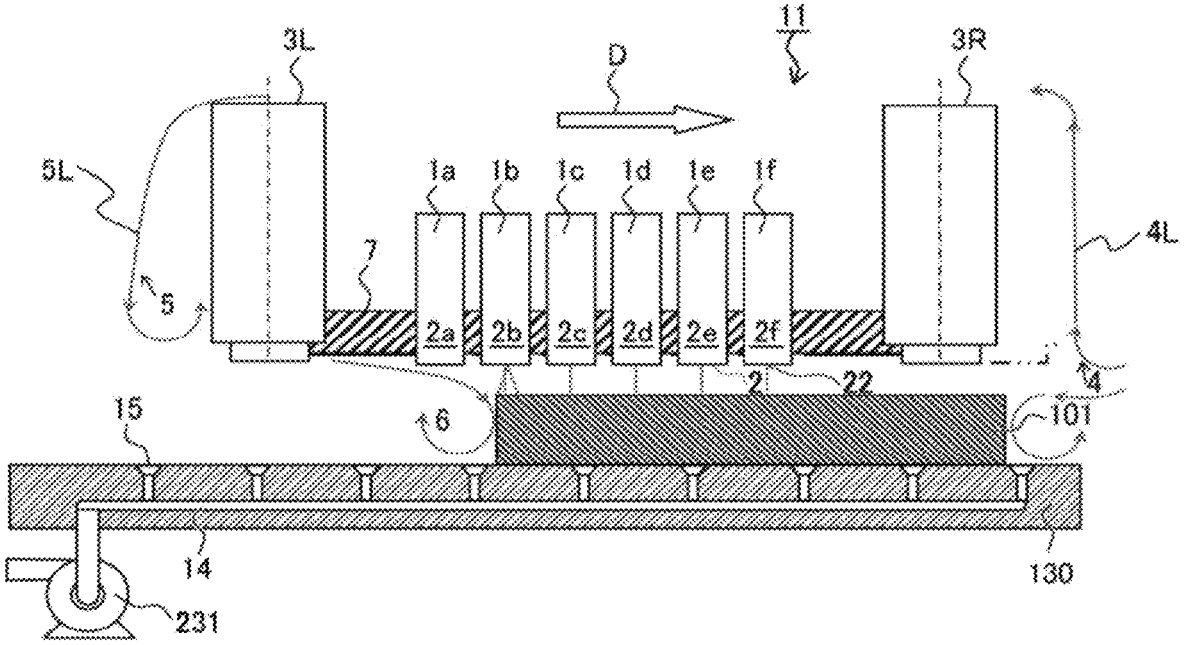
FIG. 12 is a schematic cross-sectional front view of the inkjet recording apparatus of UV ink type according to a comparative example.

FIG. 12 is a cross-sectional front view of the inkjet recording apparatus 11. The thick recording medium 101 such as a panel is set on a stage 130. The stage 130 is also referred to as a "mounting table." The stage 130 includes a large number of suction holes 15 on an upper surface of the stage 130. The stage 130 further includes a suction pipes 14 communicating with a vacuum pump 231 to attract and stably fix the thick recording medium 101 to the upper surface of the stage 130 by the vacuum pump 231.

The heads 1 (1*a*, 1*b*, 1*c*, 1*d*, 1*e*, and 1*f*) discharge the liquid (ink) onto the recording medium 101 from nozzles 22 on nozzle surfaces 2 (2*a*, 2*b*, 2*c*, 2*d*, 2*e*, and 2*f*) of the heads 1 (1*a*, 1*b*, 1*c*, 1*d*, 1*e*, and 1*f*), respectively, to form an image on the recording medium 101 during the printing process. The recording medium 101 is placed on the stage 130 during the printing process.

Hereinafter, the heads 1*a*, 1*b*, 1*c*, 1*d*, 1*e*, and 1*f* are collectively referred to as the "head 1," and the nozzle surfaces 2*a*, 2*b*, 2*c*, 2*d*, 2*e*, and 2*f* are collectively referred to as the "nozzle surface 2."

The inkjet recording apparatus 11 includes an ultraviolet-ray (UV-ray) irradiator 3L arranged on a back side (left side in FIG. 12) in the main-scanning direction of the carriage 7.

A moving (scanning) direction of the carriage 7 in the main-scanning direction is indicated by arrow "D" in FIG. 12 that is directed rightward in FIG. 12. However, the carriage 7 scans (moves) leftward and rightward in FIG. 12. The UV-ray irradiator 3L is disposed on a left end of the carriage 7. Thus, the UV-ray irradiator 3L can irradiate the liquid droplets on the recording medium 101 immediately after the heads 1 discharges the liquid droplets on the recording medium 101. The carriage 7 mounts and fixes a group of the heads 1 as a single unit.

When the carriage 7 moves rightward in the main-scanning direction from left to right indicated by arrow "D" in FIG. 12, an airflow is generated on a right side surface of a UV-ray irradiator 3R. Thus, an airflow is generated such that the airflow moves along the right side surface of the UV-ray irradiator 3R as a "carriage collision flow 4."

Further, a vortex flow may be generated on a right end surface of the recording medium 101 in a region sandwiched by the carriage 7 and the stage 130. Conversely, an airflow is generated on a left side surface of the UV-ray irradiator 3L opposite to the moving direction D of the carriage 7. The airflow moves along the left side surface of the UV-ray irradiator 3L as a "carriage following flow 5" in FIG. 12.

On the other hand, a vortex flow (turbulent airflow 6) is generated in a space surrounded by a left end surface of the recording medium 101, the stage 130, and the carriage 7. The vortex flow (turbulent airflow 6) is also referred to as a "recording medium end-surface vortex flow."

A vector and a flow rate of the above-described airflows changes according to a position, a shape, a scanning speed, or an environment of the carriage 7. Thus, the airflow does not necessarily become as illustrated in FIG. 12. Further, an airflow that is more complicated than the above-described airflows may be generated in a three-dimensional space. Thus, the airflow is not limited to the airflows that are illustrated in FIG. 12 such that a complicated airflow is also generated in a three-dimensional space.

The stage 130 includes a plurality of (large number of) suction holes 15 formed on an upper surface of the stage 130 and the suction pipe 14 communicating with the plurality of suction holes 15. The suction pipe 14 is connected to the vacuum pump 231 so that the recording medium 101 having a thickness is attracted and stably fixed to the upper surface of the stage 130 by the vacuum pump 231. There are generally many cases in the printing process using the UV inkjet-type apparatus such that a thick recording medium 101 is placed on the upper surface of the stage 130, and an image has to be formed on the marginal area of the end surface of the recording medium 101.

The head 1 of the liquid discharge device of the inkjet recording apparatus 11 discharges liquid (ink) onto the recording medium 101 immediately after the head 1 of the liquid discharge device has moved and passed the end surface of the recording medium 101 or immediately before the liquid discharge device moves and passes the end surface of the recording medium 101 to form an image on an entire surface of the thick recording medium 101.

However, with increase in a thickness of the recording medium, air around a carriage 7 or the recording medium 101 is compressed due to a "main scanning movement" of the carriage 7. The compressed air generates a rapid pressure change at the end surface of the recording medium 101. The carriage 7 mounts the head 1 (head group) that discharges the liquid and moves along the guide rod 19 to move and scan the head 1 in the main-scanning direction. Thus, a rapid pressure change occurs at the end surface of the recording medium 101 that generates an airflow (turbulent flow) such as an up-current 4L and a down current 5L.

Thus, the turbulent airflow hits a vertical portion on the end surface of the recording medium 101 so that the turbulent airflow reaches the head 1 (head group) as well. Thus, the trajectory of the liquid (ink) droplet is displaced in a direction different from an original (planed) direction that causes so-called the "landing position deviation" of the liquid (ink) droplet, or the image distortion called as the "print deviation." The above-described state indicates an occurrence of the above-described first problem.

However, due to the turbulent airflow generated by the first problem as described above, a part of the liquid (ink) droplets that should originally be landed on the recording medium 101 at appropriate timings may float and become so-called "ink mist." The ink mist may be landed on a position deviated from the original (planed) image forming area. Further, the "ink mist" adheres to a light emitting surface of the UV light source to reduce irradiation light quantity of the UV light source. Such a structure indicates an occurrence of the second problem.

Figure 13:
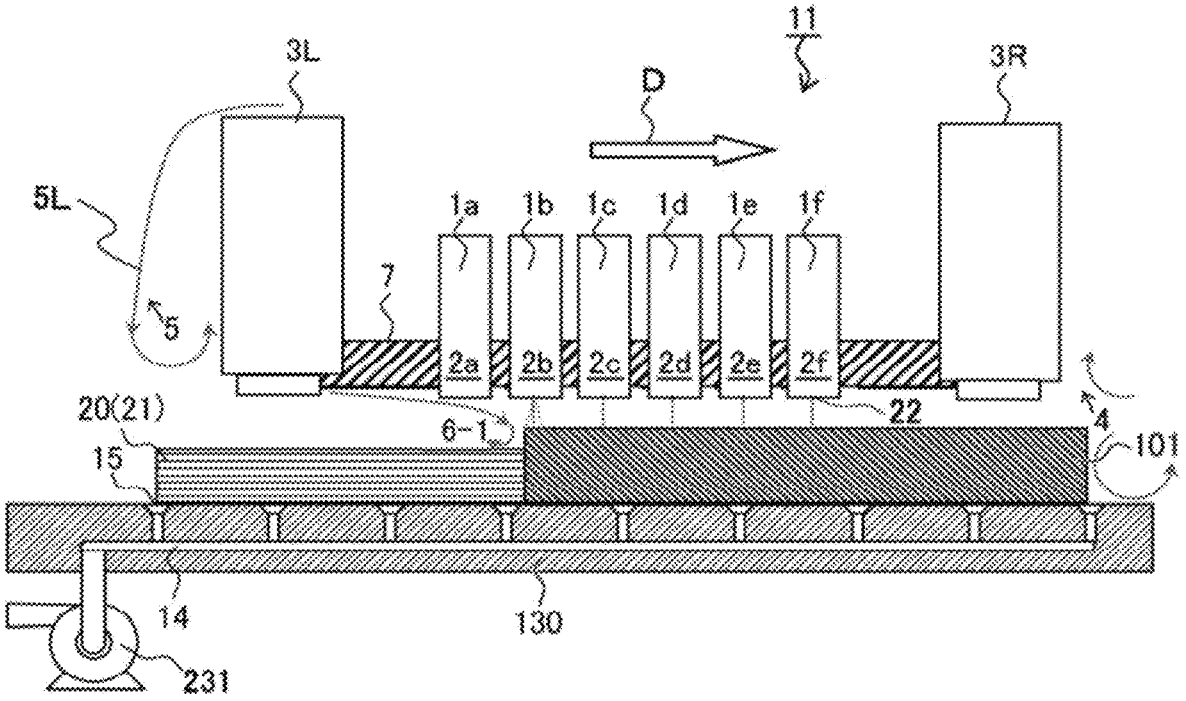
FIG. 13 is a schematic cross-sectional front view of the inkjet recording apparatus of UV ink type according to the comparative example including a device first embodiment of the present disclosure including a lamination adjacent member to reduce the turbulent airflow.
Figure 14:
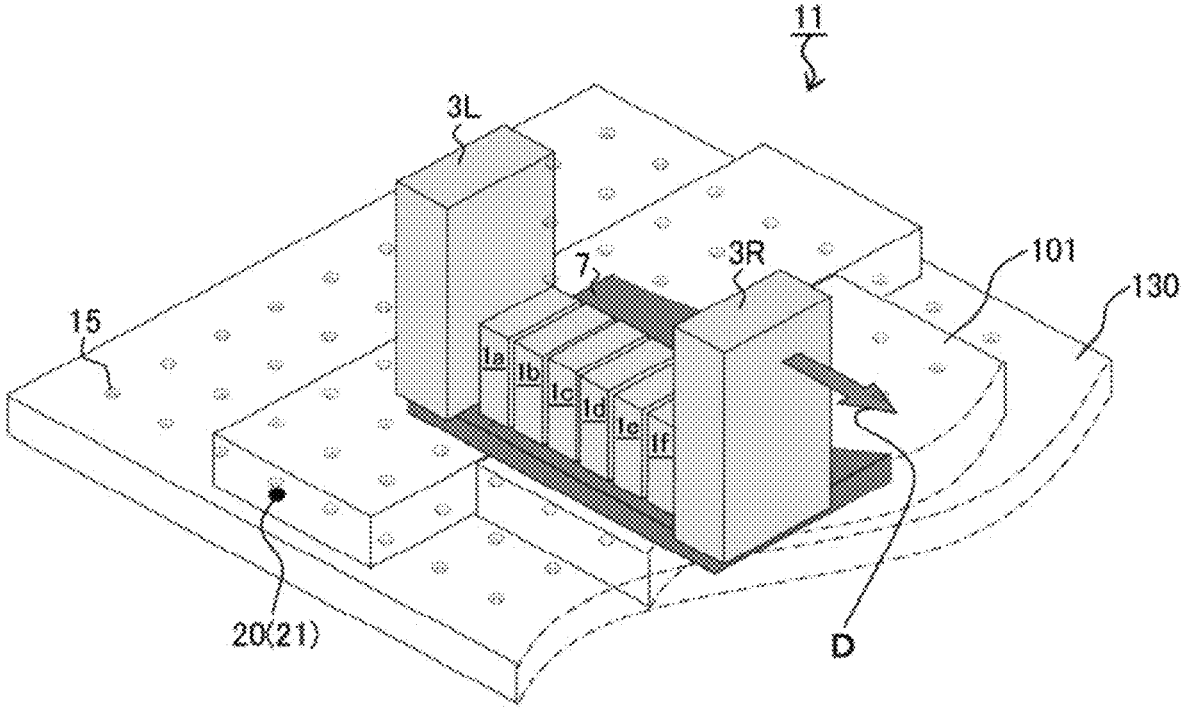
FIG. 14 is a schematic perspective view of the inkjet recording apparatus of UV ink type according to the comparative example of FIG. 13 to reduce the turbulent airflow.

As illustrated in FIGS. 13 and 14, the inkjet recording apparatus 11 includes a "dummy recording medium," a "adjacent member jig 20," or a "lamination adjacent member 21" disposed adjacent to the thick recording medium 101 to prevent occurrence of the second problem. A thickness of the dummy recording medium, the adjacent member jig 20, or the lamination adjacent member 21 is the same as a thickness of the recording medium 101 or slightly thinner than the thickness of the recording medium 101. The adjacent member jig 20 has a block shape.

In FIGS. 13 and 14, the inkjet recording apparatus 11 includes the adjacent member jig 20 or the lamination adjacent member 21 at a left end of the recording medium 101. A plane height of an upper surface of the adjacent member jig 20 or the lamination adjacent member 21 is substantially the same with a plane height of a printing surface of the recording medium 101.

The adjacent member jig 20 or the lamination adjacent member 21 can prevent a sudden (rapid) pressure change and reduce the airflow such as the vortex flow (turbulent airflow 6-1) generated at the end surface of the recording medium. The inkjet recording apparatus 11 according to the above-described comparative example illustrated in FIGS. 13 and 14 has to prepare the dummy recording medium, the adjacent member jig 20, or the lamination adjacent member 21 having a thickness according to various thicknesses of the recording medium 101.

Further, the inkjet recording apparatus 11 according to the comparative example has to prepare a plurality of types of the adjacent member jigs 20 or the lamination adjacent members 21 according to the thickness of the recording medium 101. Thus, a cost of the inkjet recording apparatus 11 increases. Further, the inkjet recording apparatus 11 according to the comparative example has to find and set the dummy recording medium, the adjacent member jig 20, or the lamination adjacent member 21 having an appropriate thickness that slows the printing process. The above-described state indicates an occurrence of the above-described third problem. The inkjet recording apparatus 10 (see FIGS. 1A and 1B) according to the present embodiment prevents the landing position deviation of the liquid (ink) droplets or the print deviation. The inkjet recording apparatus 10 is an example of a liquid discharge apparatus.

Further, the inkjet recording apparatus 10 discharges liquid (ink) onto the recording medium without generating the ink mist to easily form an image on the recording medium. The ink mist is generated by the liquid (ink) droplets that are float without landing on the recording medium.

Figure 1B:
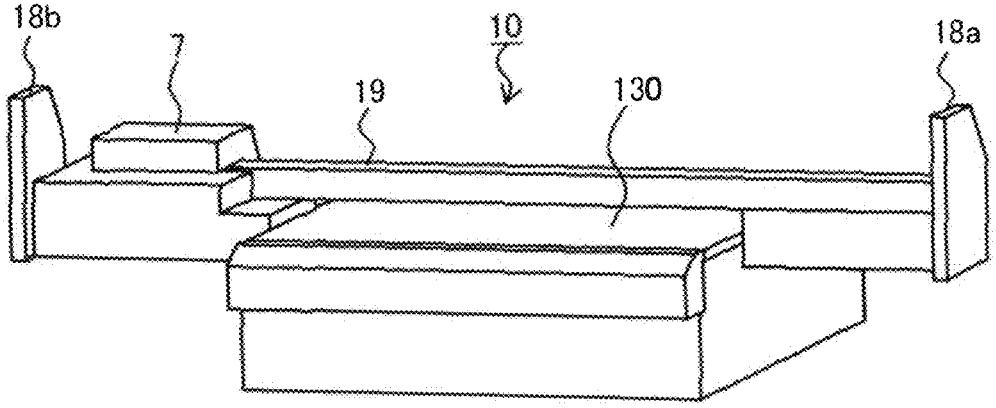

A first embodiment of the liquid discharge apparatus (inkjet recording apparatus 10) according to the present disclosure is described below. FIGS. 1A and 1B are perspective views of an entire configuration of an inkjet recording apparatus 10 as an example of a liquid discharge apparatus. FIG. 1A is a perspective front view of the inkjet recording apparatus 10. FIG. 1B is a perspective back view of the inkjet recording apparatus 10.

The inkjet recording apparatus 10 includes a carriage 7 and a stage 130 to mount a recording medium 101. The carriage 7 is an inkjet-type carriage that mounts a plurality of heads 1 (see 1*a* to 1*f* in FIG. 5) to move and scan the heads 1 in a X-direction (main-scanning direction) indicated by arrow "X" in FIG. 1. The heads 1 is a liquid discharge head that includes a plurality of nozzles 22 (see FIG. 5) from each of which the liquid (ink) droplets are discharged.

The heads 1 discharge the liquid (ink) droplets from the nozzles 22 onto the recording medium 101 to form an image on the recording medium 101. Each of the heads 1 includes the nozzles 22 on the nozzle surfaces 2 (see 2*a* to 2*f* in FIG. 5) of the heads 1 that are opposite to (facing with) the stage 13. The inkjet recording apparatus 10 according to the first embodiment of the present disclosure use a liquid (ink) having an ultraviolet curability, for example.

Further, the inkjet recording apparatus 10 includes an irradiator 400 on an opposing surface of the carriage 7 to face the stage 130. The irradiator 400 includes the UV-ray irradiator 3 (3L and 3R) as described-above. The irradiator 400 is a light source that irradiates the recording medium 101 on the stage 130 with an ultraviolet ray. The UV-ray irradiators 3 emits a light having a specific wavelength to cure the curable liquid (ink) discharged from nozzles 22 of the heads 1. The UV-ray irradiator 3 is an example of an irradiator.

The inkjet recording apparatus includes a guide rod 19 bridged between a left side plate 18*a* and a right side plate 18*b*. The guide rod 19 movably holds the carriage 7 in the main-scanning direction X. Further, the carriage 7, the guide rod 19, and the side plates 18*a* and 18*b* are formed as a single body to be movable along a guide rail 29 on a lower portion of the stage 130 in a Y-direction (sub-scanning direction) indicated by arrow "Y" in FIG. 1A. Further, the carriage 7 is movably held by the guide rod 19 in a Z-axis direction (height direction) indicated by arrow "Z" in FIG. 1A. Here, the Z-axis direction (height direction) is in a vertical direction in FIGS. 1A and 1B.

Figure 2:
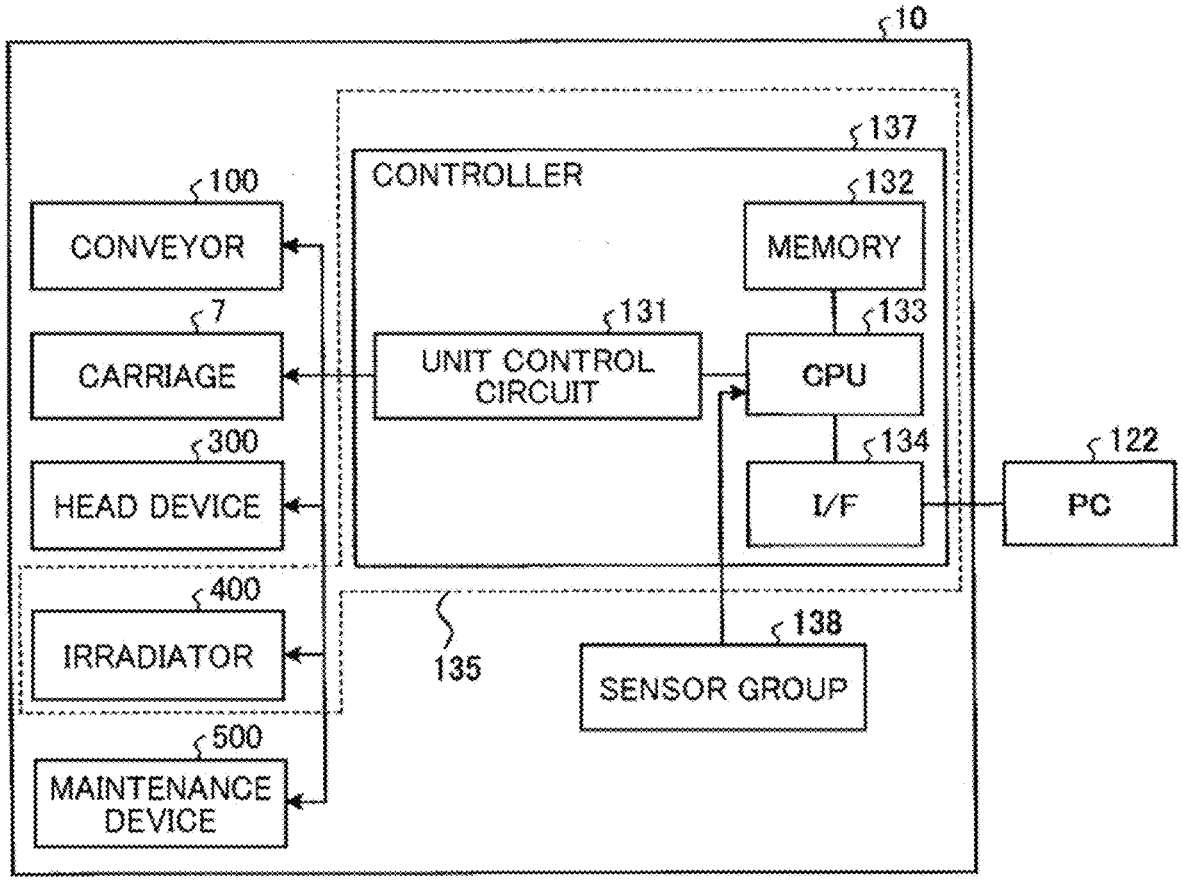
FIG. 2 is a block diagram illustrating a hardware configuration of the inkjet recording apparatus as the liquid discharge apparatus according to the first embodiment of the present disclosure.
Figure 3:
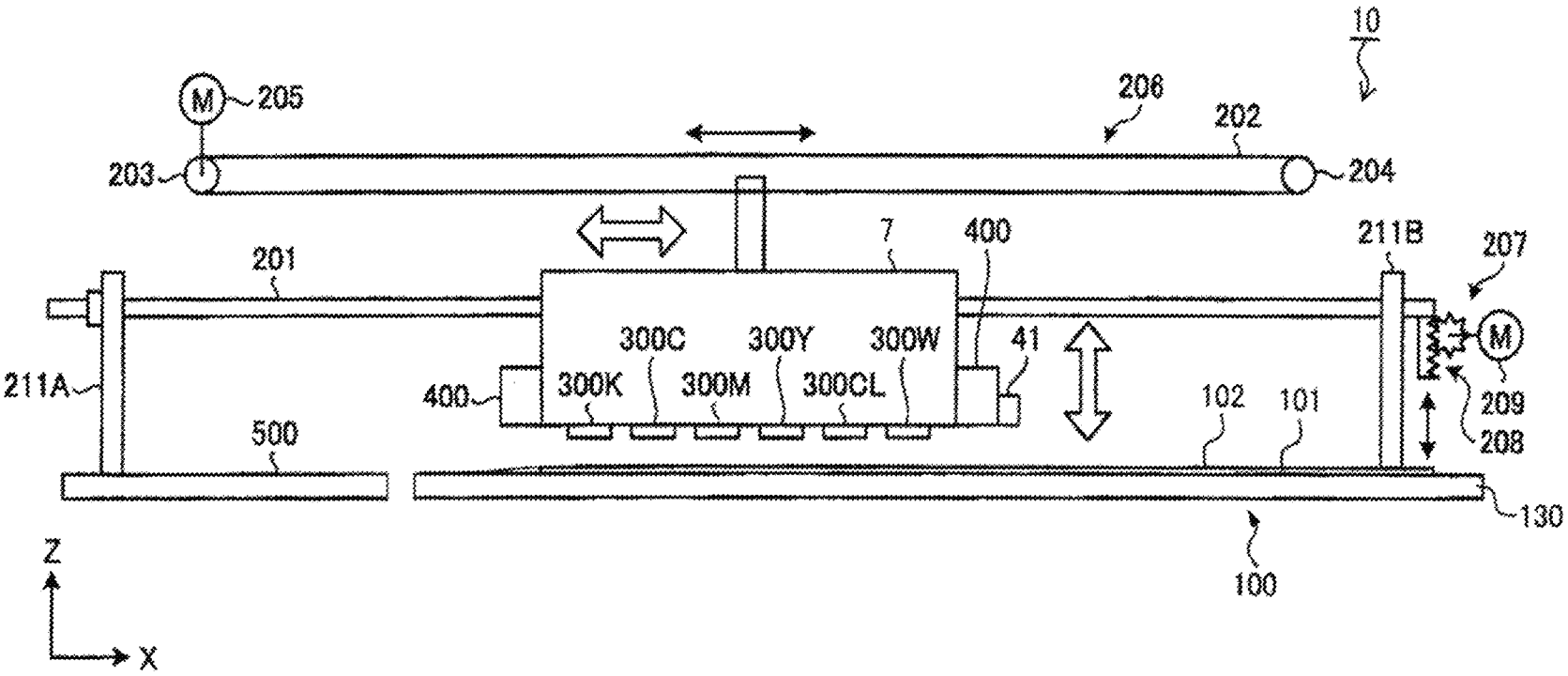
FIG. 3 is a schematic cross-sectional front view of the inkjet recording apparatus as the liquid discharge apparatus according to the first embodiment of the present disclosure.
Figure 4:
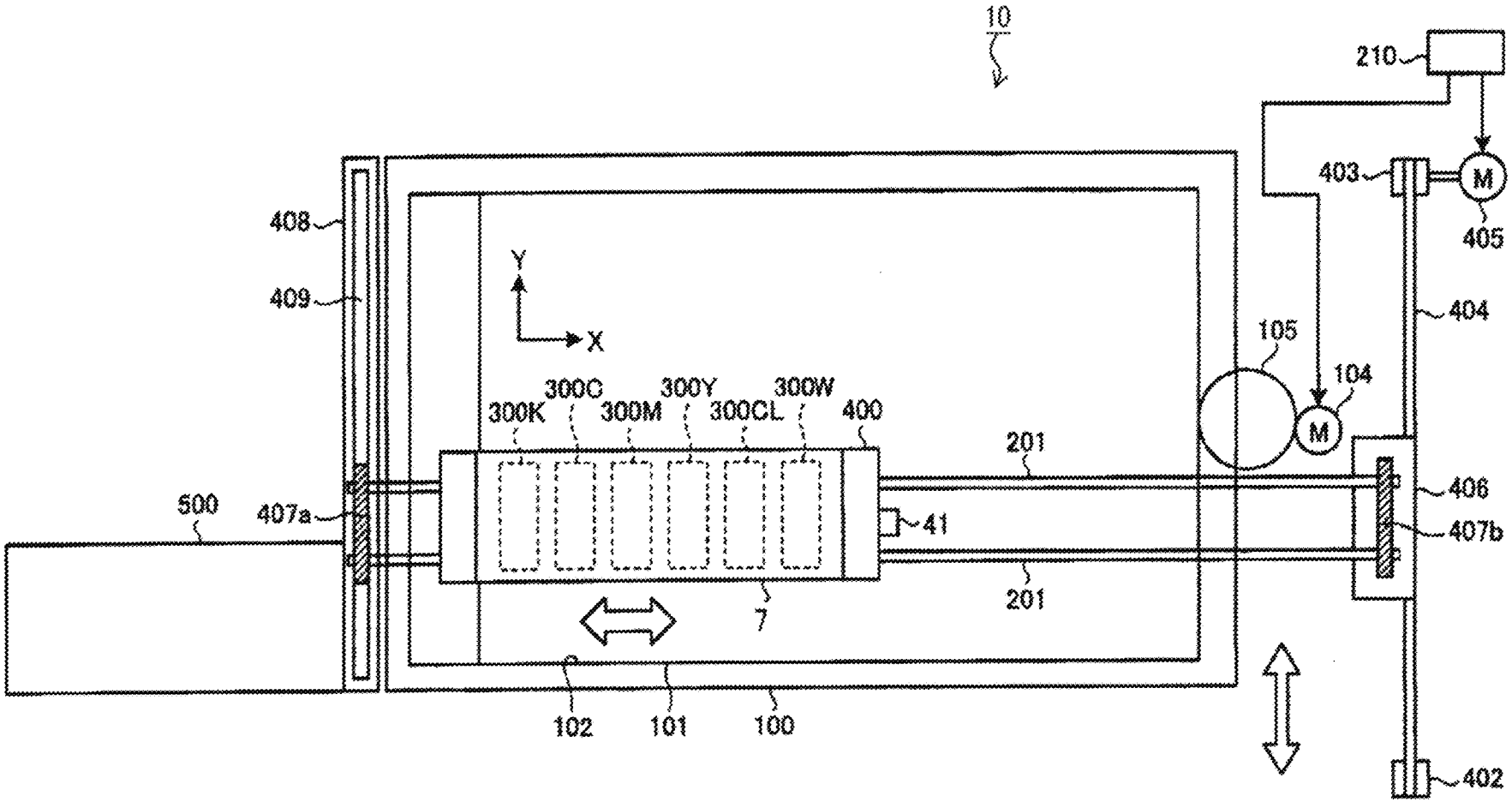
FIG. 4 is a schematic cross-sectional plan view of the inkjet recording apparatus as the liquid discharge apparatus according to the first embodiment of the present disclosure.

Next, the inkjet recording apparatus 10 according to a second embodiment of the present disclosure is described with reference to FIGS. 2 to 4 illustrating an example of a hardware configuration of the inkjet recording apparatus 10.

FIG. 2 is a block diagram illustrating a functional configuration of inkjet recording apparatus 10 as a liquid discharge apparatus according to the first embodiment of the present disclosure.

FIG. 3 is a schematic cross-sectional front view of the inkjet recording apparatus 10 according to the first embodiment of the present disclosure.

FIG. 4 is a schematic cross-sectional plan view of the inkjet recording apparatus 10 according to the first embodiment of the present disclosure.

As illustrated in FIG. 2, the inkjet recording apparatus 10 according to the first embodiment includes a controller 137, a sensor group 138, a conveyor 100, the carriage 7, a head device 300, the UV-ray irradiator 3, and a maintenance device 500. The inkjet recording apparatus 10 includes a conveyor 100 an example of a conveyor. The inkjet recording apparatus 10 includes a plurality of head devices 300 similar to the heads 1 (1*a*, 1*b*, 1*c*, 1*d*, 1*e*, and 1*f*) illustrated in FIG. 12 as an example of a liquid discharge head.

The plurality of head devices 300 (300K, 300C, 300M, 300Y, 300CL, and 300W) discharges liquids of respective colors, such as black, cyan, magenta, yellow, clear (transparent), and white. Each of the head devices 300 may include a plurality of heads 1. The UV-ray irradiator 3 is an example of an irradiator. The controller 137 includes a unit control circuit 131, a memory 132, a central processing unit (CPU) 133, and an interface (I/F) 134. A curing device 135 may be any device that includes at least the controller 137 and the UV-ray irradiator 3 as illustrated by a broken line in FIG. 2.

The I/F 134 is an interface to connect the inkjet recording apparatus 10 to an external personal computer such as the PC 122. For example, the inkjet recording apparatus 10 and the PC 122 may be connected in any form, for example, via a network or directly connected by a communication cable.

The sensor group 138 is, for example, various sensors in the inkjet recording apparatus 10 such as a height sensor 41 illustrated in FIGS. 3 and 4.

The CPU 133 of the controller 137 uses the memory 132 as a work area to control the operation of each unit of the inkjet recording apparatus 10 such as the conveyor 100, the carriage 7, the head device 300, the irradiator 400, and the maintenance device 500 via the unit control circuit 131. Specifically, the CPU 133 control operations of each unit such as the conveyor 100, the carriage 7, the head device 300, the irradiator 400, and the maintenance device 500 to form an image on the recording medium 101 based on recording data received from the PC 122 and the data detected by the sensor group 138.

The image formed on the recording medium 101 is formed by the liquid droplets discharged from the heads 1. The liquid droplets landed on the recording medium 101 form a liquid application surface 102 as illustrated in FIG. 3. The recording medium 101 is also referred to as a "substrate."

A printer driver is installed in the PC 122. The PC 122 uses the printer driver to generate recording data to be transmitted to the inkjet recording apparatus 10 from image data. The recording data includes command data to operate the conveyor 100 of the inkjet recording apparatus 10 and pixel data (print data) related to an image (liquid application surface 102) to be formed on the recording medium 101. The pixel data (print data) includes, for example, 2-bit data for each pixel, and is represented by 4 gradations.

The conveyor 100 includes the stage 130. The conveyor 100 controls a conveyance of the recording medium 101 in the Y-axis direction (sub-scanning direction Y) based on drive signals from the CPU 133 (unit control circuit 131). The conveyor 100 may have a suction mechanism such as the vacuum pump 231 as illustrated in FIG. 12.

The suction mechanism includes a fan or the vacuum pump 231, and the plurality of suction holes 15 formed on the upper surfaces of the stage 130. The suction mechanism drives the fan or the vacuum pump 231 to suck the recording medium 101 through the suction holes 15 to temporarily fix the recording medium 101 to the stage 130 of the conveyor 100. The suction mechanism may attract the recording medium 101 to the stage 130 using electrostatic attraction.

As illustrated in FIG. 4, the conveyor 100 includes a conveyance controller 210, a roller 105, and a motor 104. The conveyance controller 210 drives the motor 104 to rotate the roller 105 to move the recording medium 101 in a Y-axis direction (sub-scanning direction Y).

The conveyor 100 may move the carriage 7 instead of the recording medium 101 in the Y-axis direction (sub-scanning direction Y). That is, the conveyor 100 relatively moves at least one of the recording medium 101 and the carriage 7 in the Y-axis direction (sub-scanning direction Y).

For example, the conveyor 100 includes a side plate 407*b*, a base 406, a belt 404, a drive pulley 403, a driven pulley 402, a motor 405, and a conveyance controller 210, as illustrated on a right side of the inkjet recording apparatus 10 in FIG. 4. The side plate 407*b* supports two guides 201 that guide the carriage 7 in the X-axis direction (main-scanning direction X). The two guides 201 forms the guide rod 19 as illustrated in FIGS. 1A and 1B. The base 406 supports the side plate 407*b*. The belt 404 is fixed to the base 406. A belt 404 is wound around the drive pulley 403 and the driven pulley 402. The motor 405 rotationally drives the drive pulley 403.

Further, the conveyor 100 includes a side plate 407*a*, a base 408, and a groove 409, as illustrated on a left side of the inkjet recording apparatus 10 in FIG. 4. The side plates 407*a* and 407*b* support two guides 201 that guide the carriage 7 in the X-axis direction (main-scanning direction X). The base 408 slidably supports the side plate 407*a*. The groove 409 is formed on the base 408 and guides the side plate 407*a* in the Y-axis direction (sub-scanning direction Y).

The conveyor 100 controls the conveyance controller 210 to drive the motor 405 to rotate the drive pulley 403 and move the belt 404 in the Y-axis direction (sub-scanning direction Y). The base 406 that supports the carriage 7 moves in the Y-axis direction (sub-scanning direction Y) together with a movement of the belt 404 so that the carriage 7 is movable in the Y-axis direction (sub-scanning direction Y). The side plate 407*a* moves in the Y-axis direction (sub-scanning direction Y) along the groove 409 in the base 408 as the base 406 moves in the Y-axis direction (sub-scanning direction Y).

The head devices 300 includes head devices 300K, 300C, 300M, 300Y, 300CL, and 300W to discharge ultraviolet (UV) curable inks of respective colors of black (K), cyan (C), magenta (M), yellow (Y), transparent (CL), and white (W). The UV curable ink is an example of a liquid. Each of the head device 300 may include a plurality of heads 1. The carriage 7 mounts the head device 300 on a lower surface of the carriage 7. Each head 1 of the head device 300 includes a piezo element (piezoelectric element) as a drive source to discharge a liquid (ink) from the nozzles 22 of the head 1.

When a drive signal is applied to the piezo element by the CPU 133 (unit control circuit 131), the piezo element contracts. The piezo element in the head device 300 contracts to generate a pressure change in a liquid chamber in the head device 300 to discharge the UV curable ink from the nozzles 22 onto the recording medium 101. Thus, the liquid (ink) droplets discharged from the nozzles 22 of the head device 300 form the liquid application surface 102 on the recording medium 101. A number and an arrangement of the head devices 300 are not limited to the first embodiment as described above and may be changed appropriately.

The UV curable ink suitable in the first embodiment includes, for example, an ink containing a methacrylate monomer. Methacrylate monomer has an advantage of relatively weak skin sensitization, which is a phenomenon that causes skin irritation due to excessive immune reactions caused by chemical substances. However, methacrylate monomer has a characteristic that a degree of curing shrinkage is larger than a degree of curing shrinkage of general ink.

The UV-ray irradiator 3 is disposed on a side surface (surface in the X-axis direction) of the carriage 7. The UV-ray irradiator 3 irradiates the liquid application surface 102 on the recording medium 101 with UV light based on a drive signal from the CPU 133 (unit control circuit 131). The UV-ray irradiator 3 is mainly includes a UV irradiation lamp that emits UV light.

The carriage 7 is controlled to move in the Z-axis direction (height direction Z) and the X-axis direction (main-scanning direction X) based on a drive signal from the CPU 133 (unit control circuit 131) that functions as a movement controller.

The carriage 7 scans and moves along the guide 201 in the main-scanning direction X (X-axis direction). A scanner 206 includes a drive pulley 203, a driven pulley 204, a drive belt 202, and a motor 205. The carriage 7 is fixed to the drive belt 202 wound around the drive pulley 203 and driven pulley 204. The motor 205 drives to rotate the drive pulley 203 to move the drive belt 202 and the carriage 7 so that the carriage 7 moves and scans left and right in the main-scanning direction X (X-axis direction).

The guide 201 is supported by side plates 211A and 211B of an apparatus body of the inkjet recording apparatus 10. A height adjuster 207 includes a motor 209 and a slider 208. The height adjuster 207 drives the motor 209 to vertically move the slider 208 to vertically move the guide 201 upward and downward. As the guide 201 moves up and down, the carriage 7 also moves up and down. Thus, the height adjuster 207 can adjust a height of the carriage 7 with respect to the recording medium 101.

Following describes an image forming operation of the inkjet recording apparatus 10. The conveyor 100 moves the recording medium 101 in the Y-axis direction (sub-scanning direction Y) based on the drive signal from the CPU 133 (unit control circuit 131) so that the recording medium 101 is positioned at an initial position to form an image (liquid application surface 102) on the recording medium 101.

Then, the carriage 7 moves to a height suitable for the head device 300 to discharge the UV curable ink based on the drive signal from the CPU 133 (unit control circuit 131). Examples of the height suitable for discharging the UV curable ink include a height at which a gap between the head device 300 and the recording medium 101 becomes 1 mm. The height sensor 41 detects a height of the head device 300 so that the CPU 133 can control the height of the head device 300.

The, the carriage 7 reciprocally moves in the X-axis direction (main-scanning direction X) based on the drive signal from the CPU 133 (unit control circuit 131). During a reciprocal movement of the carriage 7, the head device 300 discharges UV curable ink onto the recording medium 101 based on the drive signal from the CPU 133 (unit control circuit 131). Thus, an image for one scan (liquid application surface 102) is formed on the recording medium 101.

When the image (liquid application surface 102) for one scan is formed on the recording medium 101, the conveyor 100 moves the carriage 7 for one scan in the Y-axis direction (sub-scanning direction Y) based on the drive signal from the CPU 133 (unit control circuit 131).

An operation of forming an image (liquid application surface 102) for one scan and an operation of moving the recording medium 101 for one scan in the Y-axis direction (sub-scanning direciton Y) are alternatively repeated until a formation of the image (liquid application surface 102) on the recording medium 101 is completed.

When the formation of the image (liquid application surface 102) on the recording medium 101 is completed, the inkjet recording apparatus 10 waits for a predetermined time until the UV curable ink on the recording medium 101 is leveled (flattened). Above-described waiting time is also referred to as "leveling time." Then, the UV-ray irradiator 3 irradiates the liquid application surface 102 on the recording medium 101 with the UV-ray.

Following describes a specific configuration of the inkjet recording apparatus 10 according to the first embodiment of the present disclosure.

Figure 5:
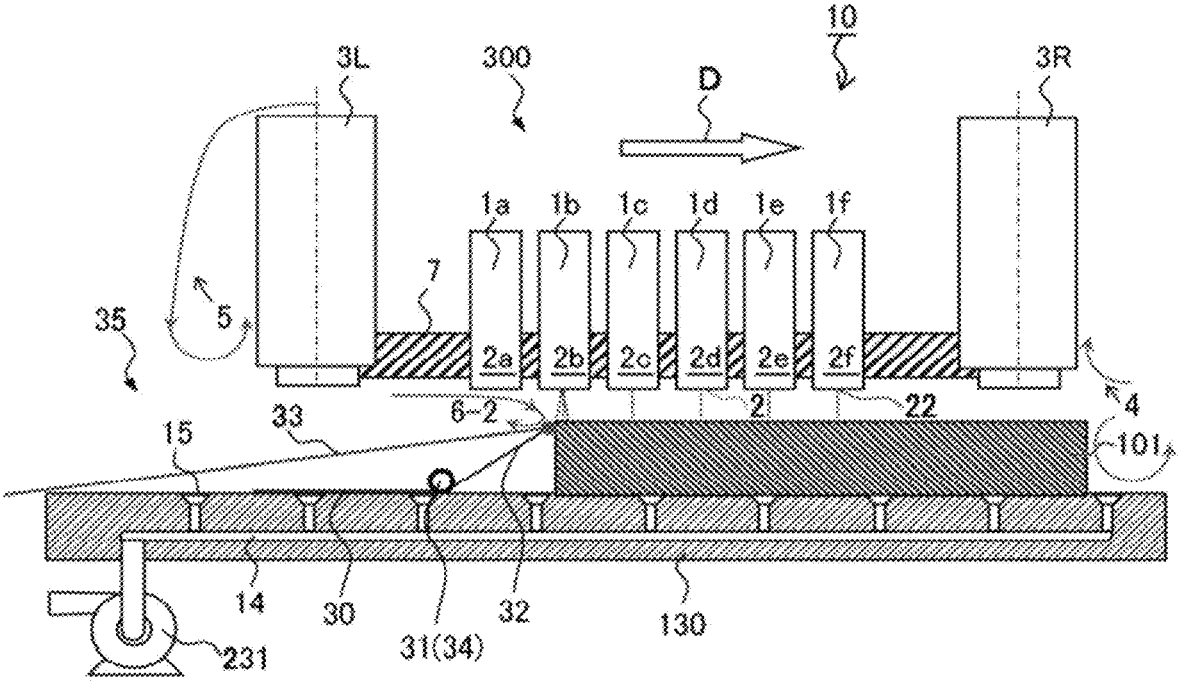
FIG. 5 is a schematic cross-sectional front view of the inkjet recording apparatus of ultraviolet (UV) ink type according to the first embodiment of the present disclosure including an inclination-plate height adjuster to reduce a turbulent airflow.
Figure 6:
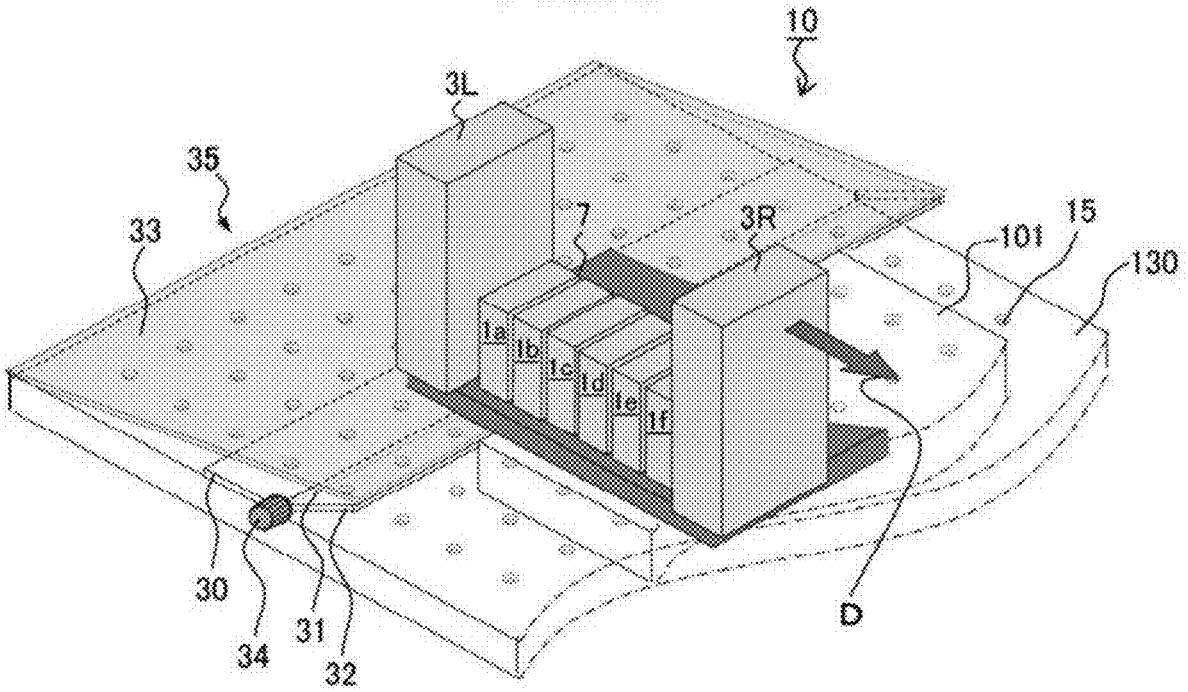
FIG. 6 is a schematic perspective view of the inkjet recording apparatus of UV ink type according to the first embodiment of FIG. 5 to reduce the turbulent airflow.

FIGS. 5 and 6 illustrate an example of the image forming process of the inkjet recording apparatus 10 according to the first embodiment of the present disclosure. FIG. 5 is a schematic cross-sectional front view of the inkjet recording apparatus 10.

FIG. 6 is a schematic perspective view of a main portion of the inkjet recording apparatus 10.

Figure 7:
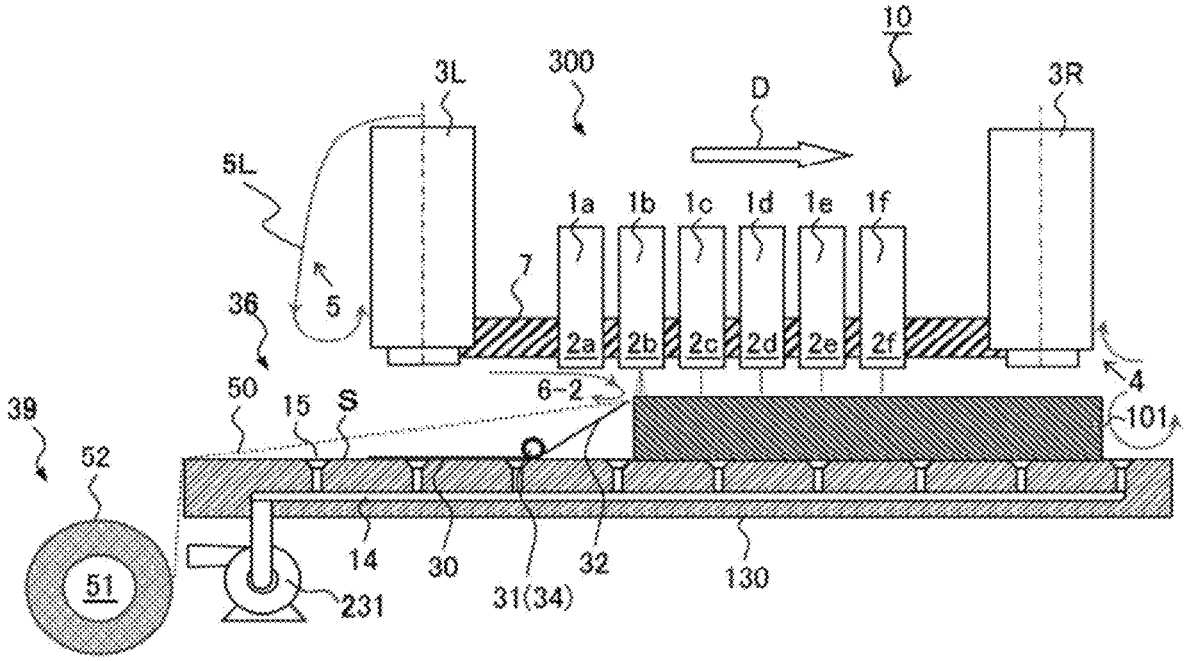
FIG. 7 is a schematic cross-sectional front view of the inkjet recording apparatus of UV ink type according to a second embodiment of the present disclosure including a flexible-film stretcher 36 to reduce the turbulent airflow.
Figure 8:
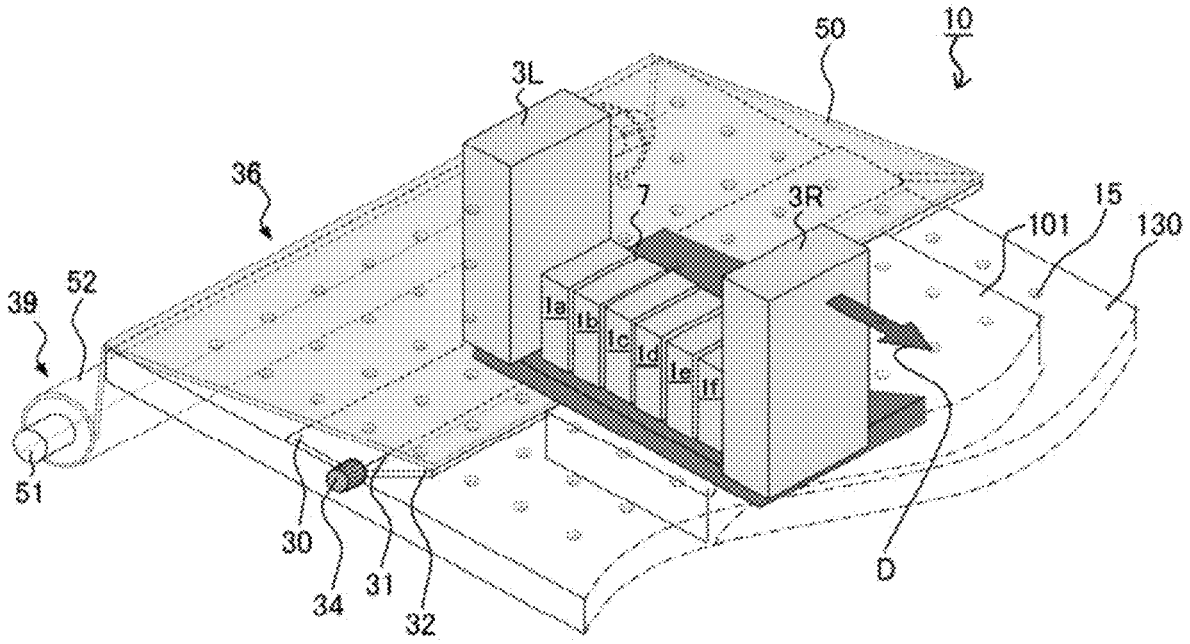
FIG. 8 is a schematic perspective view of the inkjet recording apparatus of UV ink type according to the second embodiment of FIG. 7 to reduce the turbulent airflow.

The inkjet recording apparatus 10 according to the first embodiment includes an "inclination-plate height adjuster 35" (see FIGS. 5 and 6) and a "flexible-film stretcher 36" (see FIGS. 7 and 8). FIGS. 5 and 6 illustrate an example of the inkjet recording apparatus 10 that includes the inclination-plate height adjuster 35 according to the first embodiment of the present disclosure. The inkjet recording apparatus 10 is an example of an image forming apparatus that forms an image on the recording medium 101 and a liquid discharge apparatus that discharges liquids onto the recording medium 101.

The inkjet recording apparatus 10 includes a stage piece 30, a support piece 32, an inclination plate 33, and an angle adjusting screw 34. The angle adjusting screw 34 can arbitrarily adjust a height (inclination angle) of the inclination plate 33. The inclination plate 33 and the support piece 32 serve as a substitute for the adjacent member jig 20 or the lamination adjacent member 21 as illustrated in FIGS. 13 and 14. The inclination plate 33 has a flat-plate shape (also referred to as "flat plate").

The inclination plate 33 is an example of an inclined wall to reduce the turbulent airflow generated in an area adjacent to the end surface of the recording medium 101.

The support piece 32 is in line contact with one end (right end in FIG. 5) of the inclination plate 33 to support the inclination plate 33 at an end surface (left end surface in FIG. 5) of the recording medium 101 so that the inclination plate 33 is inclined. The one end (right end) of the inclination plate 33 that contacts the support piece 32 is at a height substantially equal to a thickness of the recording medium 101 or slightly lower than the thickness of the recording medium 101. The stage piece 30 fixes the support piece 32 to the stage 130. The angle adjusting screw 34 includes a knob and an angle adjusting hinge 31. The angle adjusting hinge 31 holds (connects) two pieces of the support piece 32 and the stage piece 30 such that the angle adjusting screw 34 can arbitrarily change an attachment angle of the support piece 32 and the stage piece 30.

Thus, the angle adjusting hinge 31 variably adjusts the angle between the support piece 32 and the stage piece 30.

Thus, the angle adjusting screw 34 can arbitrarily adjust and set the one end (right end in FIG. 5) of the inclination plate 33 at the height equal to the thickness of the recording medium 101 or the height slightly lower than the thickness of the recording medium 101. The right end (one end) of the inclination plate 33 is the highest portion of the inclination plate 33.

In FIGS. 5 and 6, a left end (another end) of the inclination plate 33 opposite to the right end (one end) of the inclination plate 33 (opposite to the carriage 7 side) that contacts the support piece 32 is free and is in contact with the upper surface of the stage 130 due to gravity. The inclination plate 33 cover a part of the stage 130. The left end (another end) of the inclination plate 33 may protrude outside a left end of the stage 130 as illustrated in FIG. 5. In FIG. 5 also, the left end (another end) of the inclination plate 33 is not limited to an edge of the inclination plate 33 and has a certain area to cover and contact the upper surface of the stage 130.

Thus, FIGS. 5 and 6 illustrate an example of the inclination-plate height adjuster 35. FIGS. 5 and 6 illustrate an embodiment in which each end of the support piece 32 and the inclination plate 33 is in line contact. However, an area of line contact is not limited to each end of the support piece 32 and the inclination plate 33, and the area of line contact may include a part of the end of the support piece 32 and the inclination plate 33.

FIGS. 5 and 6 illustrate the head device 300 (discharger device), the UV-ray irradiator 3 (3L and 3R), the inclination plate 33, the support piece 32, the stage piece 30, the angle adjusting hinge 31, the carriage 7, the recording medium 101, and the stage 130, for example. The UV-ray irradiator 3 is an example of an irradiator.

The main-scanning direction X (X-axis direction) in which the carriage 7 moves is indicated by arrow "D" in FIG. 6. The inkjet recording apparatus 10 according to the first embodiment includes the head device 300 and the UV-ray irradiator 3 fixed to the carriage 7 as a single body.

After the head device 300 appropriately discharges the ink (liquid) droplets from the nozzles 22 onto the recording medium 101, the UV-ray irradiator 3 irradiates the liquid application surface 102 on the recording medium 101 with light rays such as ultraviolet rays. FIG. 5 illustrates an example in which the UV-ray irradiator 3L irradiates the UV-rays (light beam) after the heads 1 of the head device 300 discharges ink (liquid) droplets on the recording medium 101. The head device 300 includes heads 1*a* to 1*f*.

FIGS. 5 and 6 illustrate the UV-ray irradiators 3L and 3R. However, the UV-ray irradiators 3L and 3R may be simply and collectively referred to as an "irradiator 3". A "light-ray" means a light beam emitted from the UV-ray irradiator 3L. The light ray includes the UV-ray. When the light-rays (UV-ray) emitted from the UV-ray irradiators 3L and 3R are not distinguished, both of the light-rays (UV-rays) are simply referred to as a light-ray, for example.

In FIG. 5, the heads 1 discharge the ink and the UV-ray irradiator 3L irradiates the liquid application surface 102 on the recording medium 101 with the UV-rays during the carriage 7 scans (moves) from left to right of a sheet surface of the recording medium 101 in the main-scanning direction X (X-axis direction) indicated by arrow D.

However, the heads 1 may discharge the ink and the UV-ray irradiator 3L may irradiate the liquid application surface 102 on the recording medium 101 with the UV-rays during the carriage 7 scans (moves) from right to left opposite to the direction indicated by arrow D of the sheet surface of the recording medium 101 in the main-scanning direction X (X-axis direction).

The inkjet recording apparatus 10 in the first embodiment includes the inclination plate 33 extending to a position adjacent to the right end of the recording medium 101 in FIG. 5. The inclination plate 33 extends from the end (left end in FIG. 5) of the stage 130 to a position adjacent to the end surface of the recording medium 101. An end position (right end position in FIG. 5) of the inclination plate 33 is at the same position as the upper surface (liquid application surface 102) of the recording medium 101 or a position slightly lower than the upper surface (liquid application surface 102) of the recording medium 101.

The liquid application surface 102 is also referred to as a "liquid discharge surface." The term "adjacent" may be referred to as "approaching" or the like. The term "adjacent" may include a state in which the inclination plate 33 is close enough to the recording medium 101 in a degree in which the turbulent airflow 6-2 between the carriage 7 and the stage 130 is smoothly guided by the inclination plate 33. Thus, the inclination plate 33 does not have to be in contact with the end of the recording medium 101 (same as below).

The inclination plate 33 may be arranged on a downstream side (left side in FIG. 5) of the end surface of the recording medium 101 in the direction indicated by arrow D in the main-scanning direction X (X-axis direction) of the carriage 7 in FIG. 5 in the first embodiment. As illustrated in FIG. 5, the inclination plate 33 is disposed at the downstream side of the end surface of the recording medium 101 in the X-axis direction (main-scanning direction X). The inclination plate 33 may also be arranged on one of an upstream side and a downstream side of the end surfaces of the recording medium 101 in the Y-axis direction (sub-scanning direction Y) in a plan view in FIG. 4, for example.

However, an effect of the embodiment having the inclination plate 33 on one side in the Y-axis direction (sub-scanning direction Y) may be less than an effect the embodiment having the inclination plate 33 on the downstream side of the end surface of the recording medium 101 in the X-axis direction (main-scanning direction X) as illustrated in FIG. 5. The inclination plate 33 may also be arranged on both sides (upstream side and downstream side) of the end surfaces of the recording medium 101 in the X-axis direciton (main-scanning direction X) as described below.

Thus, the inkjet recording apparatus 10 in the first embodiment includes the inclination-plate height adjuster 35 that includes the support piece 32, the stage piece 30, the angle adjusting hinge 31, and the angle adjusting screw 34. The inkjet recording apparatus 10 according to the first embodiment including the inclination plate 33 can prevent the UV-ray (light-ray), emitted from the UV-ray irradiator 3 (3L and 3R) and reflected from the stage 130, from reaching the nozzle surface 2 (2*a* to 2*f*) of the head device 300K in FIG. 4 or the head 1 (1*a* to 1*f*) in FIG. 5.

Examples of the recording medium 101 includes a plaster board, a panel, a block, a steel frame, and a sheet metal of a material having a thickness. The recording medium 101 is not particularly limited and may be appropriately selected to suit to a particular application. Specific examples of the recording medium include, but are not limited to, paper, thread, fiber, cloth, leather, metal, plastic, glass, wood, ceramics, and composite materials of the above-described materials. The thickness of the recording medium 101 is not limited to any particular value, but it is preferably, for example, in a range from 0.018 mm to 100 mm. The greater the thickness of the recording medium 101, the greater the effect of the first embodiment of the present disclosure.

The inkjet recording apparatus 10 according to the first embodiment can arbitrarily set the height of the highest portion of the inclination plate 33 by the angle adjusting hinge 31 and the angle adjusting screw 34 of the inclination-plate height adjuster 35. Thus, the inkjet recording apparatus 10 can easily adjust the height of the highest portion of the inclination plate 33 according to the thickness of the recording medium 101. Therefore, the inkjet recording apparatus 10 does not have to change the inclination plate 33 according to the thickness of the recording medium 101. Thus, the inkjet recording apparatus 10 can reduce cost and labor of changing the dummy recording medium, the adjacent member jig 20, or the lamination adjacent member 21 illustrated in FIGS. 12 to 14.

The inkjet recording apparatus 10 in the first embodiment includes the inclination-plate height adjuster 35 that includes the angle adjusting hinge 31 and the angle adjusting screw 34 to change the angle between the support piece 32 and the stage piece 30 to adjust the height of the highest portion of the inclination plate 33 to be slightly lower than the highest portion of the recording medium 101. A device to hold one end of the inclination plate 33 at the end surface of the recording medium 101 is not particularly limited and may be appropriately changed.

The inclination-plate height adjuster 35 is not limited to a configuration in the first embodiment and may be appropriately changed. In addition to the configuration according to the first embodiment, for example, a member including a part or all of the parts of the inclination-plate height adjuster 35 in a single body may be used.

Setting of the above-described inclination-plate height adjuster 35 is not particularly limited and may be appropriately changed. For example, holes or grooves may be formed in the stage 130, and the inclination-plate height adjuster 35 may be fitted into the holes or grooves.

The inclination-plate height adjuster 35 is preferably set so that the inclination-plate height adjuster 35 is arbitrarily movable on the stage 130. Thus, the inclination-plate height adjuster 35 is easily adjustable the height of the inclination plate 33 according to the thickness of the recording medium 101. Timing of movement of the inclination plate 33 may be appropriately changed. For example, the inclination-plate height adjuster 35 may be moved before a conveyance of the recording medium 101 or moved during the conveyance of the recording medium 101. The inclination-plate height adjuster 35 is preferably movable with the recording medium 101 as a single body.

FIGS. 7 and 8 illustrate an example of the inkjet recording apparatus 10 that includes a "flexible-film stretcher 36" according to a second embodiment of the present disclosure. The inkjet recording apparatus 10 is an example of an image forming apparatus that forms an image on the recording medium 101 and a liquid discharge apparatus that discharges liquids onto the recording medium 101. The inkjet recording apparatus 10 includes a stage piece 30, a support piece 32, a flexible film 50, an angle adjusting hinge 31, and an angle adjusting screw 34. The angle adjusting screw 34 can arbitrarily adjust a height (inclination angle) at the highest position of the flexible film 50.

The flexible film 50 is another example of the inclined wall to reduce the turbulent airflow generated in the area adjacent to the end surface of the recording medium 101.

The flexible film 50 and the support piece 32 serve as a substitute for the adjacent member jig 20 or the lamination adjacent member 21 as illustrated in FIGS. 13 and 14. The support piece 32 stretches one end (right end in FIG. 7) of the flexible film 50 to a height substantially equal to a thickness of the recording medium 101 or a height slightly lower than the thickness of the recording medium 101 at one end surface (left end surface in FIG. 7) of the recording medium 101. The flexible film 50 is flexible and has a sheet-like shape. The stage piece 30 fixes the support piece 32 to the stage 130. The angle adjusting screw 34 includes a knob and an angle adjusting hinge 31.

The angle adjusting hinge 31 holds (connects) two pieces of the support piece 32 and the stage piece 30 such that the angle adjusting screw 34 can arbitrarily change an attachment angle of the support piece 32 and the stage piece 30.

Thus, the angle adjusting screw 34 can arbitrarily adjust and set the one end (right end in FIG. 5) of the flexible film 50 to the height substantially equal to the thickness of the recording medium 101 or to the height slightly lower than the thickness of the recording medium 101.

The right end of the flexible film 50 is the highest portion of the flexible film 50. In FIGS. 7 and 8, an opposite end (left end in FIG. 7) of the flexible film 50 is held by a winding shaft 51 as a web 52 so that the web 52 (flexible film 50) can be pulled out or rewound to a desired length by the winding shaft 51. FIGS. 7 and 8 illustrate an example of a "flexible-film stretcher 36".

FIGS. 7 and 8 illustrate an example of the inkjet recording apparatus 10 that includes the "flexible-film stretcher" according to the second embodiment of the present disclosure. The flexible-film stretcher 36 includes the support piece 32, the stage piece 30, the angle adjusting hinge 31, and the angle adjusting screw 34. The flexible-film stretcher 36 can arbitrarily set the height of one end (right end in FIG. 7) of the support piece 32 and the flexible film 50 with the angle adjusting screw 34.

The right ends of the support piece 32 and the flexible film 50 are at the highest positions of the support piece 32 and the flexible film 50, respectively. The support piece 32 holds one end (right end in FIG. 7) of the flexible film 50 at a position adjacent to one end surface (left end surface in FIG. 7) of the recording medium 101. The support piece 32 may also holds one end (right end in FIG. 5) of the inclination plate 33 at a position adjacent to one end surface (left end surface in FIG. 5) of the recording medium 101. The stage piece 30 fixes one end (left end in FIG. 7) of the support piece 32 to the stage 130. Further, another end (right end in FIG. 7) of the support piece 32 is rotationally movable around the angle adjusting hinge 31.

Thus, the recording medium 101 on the stage 130 is movable along the upper surface of the stage 130 while the right end of the flexible film 50 contacting the left end surface of the recording medium 101. The angle adjusting hinge 31 holds (connects) two pieces of the support piece 32 and the stage piece 30 such that an attachment angle of the two pieces of the support piece 32 and the stage piece 30 is variable. The angle adjusting screw 34 can arbitrarily change the attachment angle of the two pieces of the support piece 32 and the stage piece 30.

A main-scanning movement of the carriage 7 in the X-axis direction (main-scanning direction X) generates a turbulent airflow 6. With increase in a thickness of the recording medium 101, compression of air near the carriage 7 or the recording medium 101 increases due to the main-scanning movement of the carriage 7 in the X-axis direction (main-scanning direction X). The compressed air generates a rapid pressure change at the end surface of the recording medium 101. The rapid pressure change generates the turbulent airflow 6.

Thus, the turbulent airflow 6 hits a vertical portion on the end surface of the recording medium 101 so that the turbulent airflow 6 reaches the head 1 as well. Thus, the trajectory of the liquid (ink) droplet may be displaced in a direction different from an original (planed) direction that causes so-called the "landing position deviation" of the liquid (ink) droplet, or image distortion called the "print deviation." Thus, the airflow (turbulent airflow 6) that causes the first problem is generated.

However, the inclination plate 33 (see FIGS. 5 and 6) and the flexible film 50 (see FIGS. 7 and 8) provided near the end surface of the recording medium 101 can reduce the turbulent airflow 6-2 generated near the end surface of the recording medium 101.

To rapidly cure and fix the liquid (ink) droplets that have landed on the recording medium 101, the inkjet recording apparatus 10 includes the UV-ray irradiator 3 that is installed at least on a downstream side in the X-axis direction (main-scanning direction X) of the carriage 7 that mounts the heads 1. The UV-ray irradiator 3 includes an ultraviolet (UV) light source that generates UV rays (UV light). Thus, the ink droplets are instantly cured by the UV ray (UV light) emitted from the UV-ray irradiator 3 to the liquid application surface 102 of the recording medium 101 immediately after landing of the liquid (ink) droplets on the recording medium 101.

However, due to the turbulent airflow generated by the first problem as described above, a part of the liquid (ink) droplets that should originally be landed on the recording medium 101 at appropriate timings may float and become so-called "ink mist." The ink mist may be landed on a position deviated from the original (planed) image forming area.

Further, the "ink mist" adheres to a light emitting surface of the UV light source of the UV-ray irradiator 3 to reduce irradiation light quantity of the UV light source.

Conversely, the inkjet recording apparatuses 10 according to the first embodiment (see FIGS. 5 and 6) and the second embodiment (see FIGS. 7 and 8) can reduce the turbulent airflow that causes the second problem.

Further, the dummy recording medium, the adjacent member jig 20, or the lamination adjacent member 21 as illustrated in FIGS. 13 and 14 may be used to prevent the ink mist and the turbulent airflow in the second problem. However, the dummy recording medium, the adjacent member jig 20, or the lamination adjacent member 21 causes the third problem in which the dummy recording medium, the adjacent member jig 20, or the lamination adjacent member 21 having an appropriate thickness has to be found and installed on the stage 130 in advance at a position adjacent to the end surface of the recording medium 101 to prevent the second problem caused by the ink mist. Conversely, the inkjet recording apparatuses 10 according to the first embodiment and the second embodiment can solve the above-described third problem.

FIGS. 7 and 8 illustrate the flexible-film stretcher 36 and the thick recording medium 101 placed on the stage 130. In FIGS. 7 and 8, the angle adjusting screw 34 adjusts an angle between the support piece 32 and the stage piece 30 at the angle adjusting hinge 31 so that the right end of the support piece 32 and the right end of the flexible film 50 is at a height of a printing surface (liquid application surface 102) of the recording medium 101. An uppermost ridgeline of an oblique side (right side in FIG. 7) of the stretched flexible film 50 is aligned with the printing surface (upper surface) of the recording medium 101. The liquid application surface 102 (see FIG. 3) is formed on the printing surface of the recording medium 101.

Further, the inkjet recording apparatus 10 in the second embodiment includes a winder 39 that includes the winding shaft 51 and the web 52 wound around the winding shaft. The winder 39 includes a motor to rotate the winding shaft 51 to wind the web 52 (flexible film 50). As illustrated in FIGS. 7 and 8, one end (left end in FIG. 7) opposite to another end (right end in FIG. 7) of the flexible film 50 adjacent to the left end surface of the recording medium 101 is wound around the winding shaft 51 into a web shape as the web 52 by the winding shaft 51. The winder 39 can draw out the web 52 (flexible film 50) and rewind the web 52 around the winding shaft 51 to a predetermined length, as necessary.

As illustrated in FIG. 7, the winder 39 winds the flexible film 50 around the winding shaft 51 in a web form as the web 52. The winding shaft 51 of the winder 39 is disposed outside the stage 130 and is lower than an upper surface "S" (see FIG. 7) of the stage 130.

Such a structure illustrated in FIG. 7 has an advantage of compactly storing the flexible film 50 (web 52).

Next, the inkjet recording apparatus 10 according to a third embodiment of the present disclosure is described below with reference to FIGS. 9 and 10. A configuration of the stage piece 30 in the third embodiment is different from a configuration of the stage piece 30 in the first embodiment (see FIGS. 5 and 6) and second embodiments (see FIGS. 7 and 8).

Figure 9:
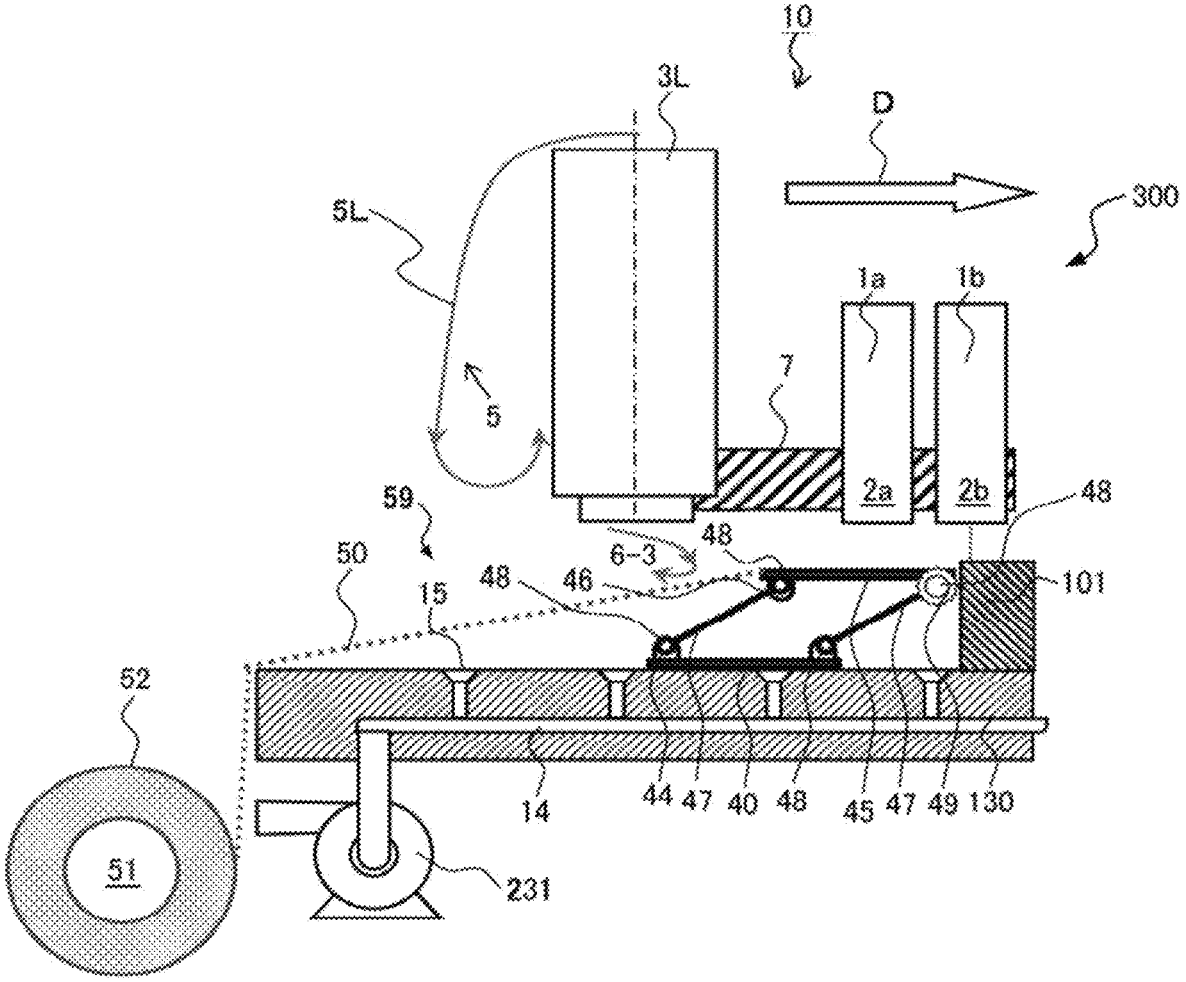
FIG. 9 is a schematic cross-sectional front view of the inkjet recording apparatus of UV ink type according to the third embodiment of the present disclosure including a parallel height adjuster to reduce the turbulent airflow.

FIG. 9 is a schematic cross-sectional front view of a part of the inkjet recording apparatus 10. FIG. 10 is a schematic perspective view of a part of the inkjet recording apparatus 10 of FIG. 9. The inkjet recording apparatus 10 according to the third embodiment includes a stage piece 40 having a structure in which the stage piece 40 is arbitrarily movable on the stage 130.

Figure 10:
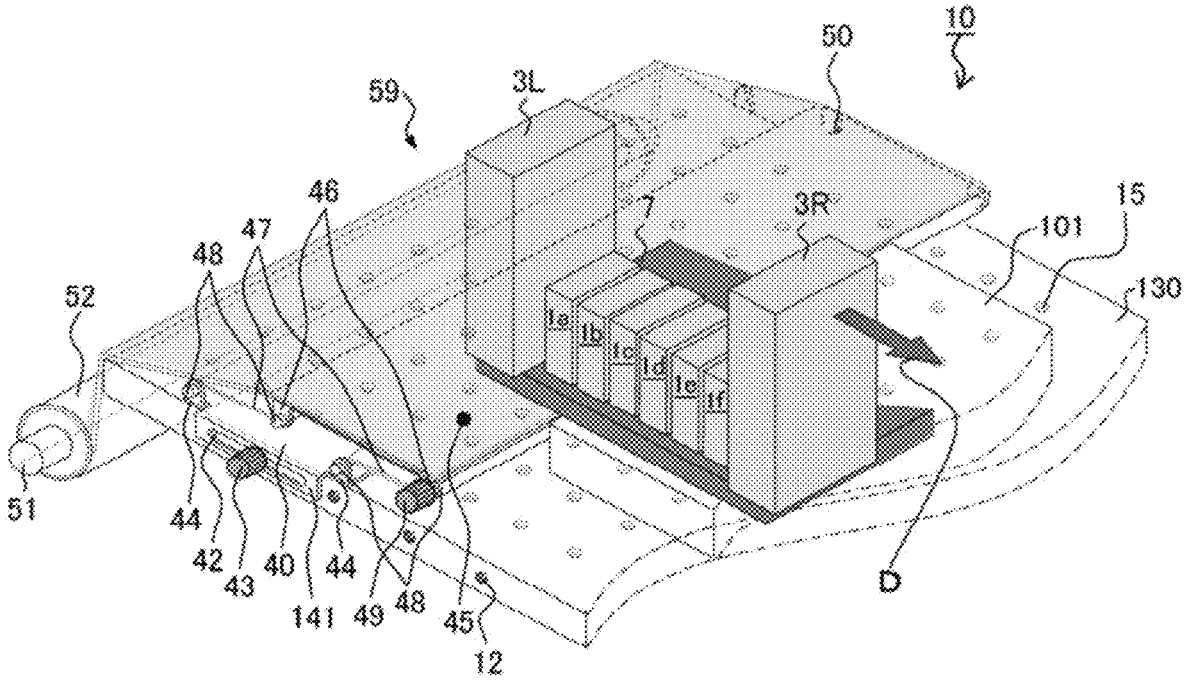
FIG. 10 is a schematic perspective view of the inkjet recording apparatus of UV ink type according to the third embodiment of FIG. 9 to reduce the turbulent airflow.

As illustrated in FIG. 10, the inkjet recording apparatus 10 according to the third embodiment includes a fixing flap 141 on at least one end of the stage piece 40 and an adjusting elongated hole 42 in the fixing flap 141. The stage piece 40 and the fixing flap 141 are slidably movable along an upper surface of the stage 130. Further, the inkjet recording apparatus 10 includes screw holes 12 at one position or at several positions on an end surface of the stage 130 as illustrated in FIG. 10. The fixing screw 43 is screwed into the screw holes 12 so that the fixing flap 141 is sandwiched and fixed between fixing screw 43 and the screw holes 12.

Thus, the stage piece 40 can be securely fixed to the stage 130 at an arbitral position of the stage 130. Therefore, the inkjet recording apparatus 10 according to the third embodiment can prevent the displacement of the inclination plate 33 or the flexible film 50 due to a vibration of the inkjet recording apparatus 10 or a wind pressure by a scanning movement of the carriage 7, for example. Further, the flexible film 50 can prevent a problematic turbulent airflow 6-3 from affecting the printing operation.

Further, the above-described inclination plate 33 (flat plate) and the flexible film 50 may be made of a material including plurality of pores. The inkjet recording apparatus 10 performs the printing process by overrunning the heads 1 outside an end the recording medium 101 to perform printing up to very end (rear end) of the recording medium 101 in the X-axis direction (main-scanning direction X).

Then, the liquid (ink) droplets discharged from the heads 1 are repeatedly landed on a surface of the inclination plate 33 or the flexible film 50. Then, the liquid (ink) droplets landed and laminated on the inclination plate 33 or the flexible film 50 causes unevenness of a surface of the inclination plate 33 or the flexible film 50. Thus, flatness of the surface of the inclination plate 33 or the flexible film 50 deteriorates. To keep flatness of the surface of the inclination plate 33 or the flexible film 50, the inclination plate 33 or the flexible film 50 is made of material having pores to prevent ink from accumulating on the inclination plate 33 or the flexible film 50 and ensure air permeability of the inclination plate 33 or the flexible film 50.

For example, the inkjet recording apparatus 10 may include the vacuum pump 231 communicating with the suction pipe 14 (see FIGS. 5, 7, and 9) and the suction holes 15 (see FIGS. 6, 8, and 10). The vacuum pump 231 vacuums air from the suction holes 15 through the suction pipe 14 to suck the liquid (ink) droplets from the inclination plate 33 or the flexible film 50. Thus, the inkjet recording apparatus 10 can stably keep the surface of the inclination plate 33 or the flexible film 50 to be flat.

Further, the inclination plate 33 (flat plate) or the flexible film 50 may be made of a "material having water repellency to the liquid (ink)". The inkjet recording apparatus 10 performs the printing process by overrunning the heads 1 outside an end (edge) the recording medium 101 to perform printing up to very end (rear end) of the recording medium 101 in the X-axis direction (main-scanning direction X). Thus, the liquid (ink) droplets discharged from the heads 1 are repeatedly landed on a surface of the inclination plate 33 or the flexible film 50.

Then, the liquid (ink) droplets landed and laminated on the inclination plate 33 or the flexible film 50 causes unevenness of a surface of the inclination plate 33 or the flexible film 50. Thus, flatness of the surface of the inclination plate 33 or the flexible film 50 deteriorates. To keep flatness of the surface of the inclination plate 33 or the flexible film 50, the inclination plate 33 or the flexible film 50 is made of material having water repellency to the liquid (ink) so that the ink adhered on the surface of the inclination plate 33 or the flexible film 50 is easier to wiped off. Thus, the inkjet recording apparatus 10 can stably keep the surface of the inclination plate 33 or the flexible film 50 to be flat.

As illustrated in FIGS. 9 and 10, the inkjet recording apparatus 10 according to the third embodiment includes a "parallel height adjuster 59." The parallel height adjuster 59 can adjust the highest position of the flexible film 50 so that the highest position of the flexible film 50 forms a parallel plane that is parallel with an uppermost plane (upper surface) of the recording medium 101. The parallel height adjuster 59 adjust a height of the parallel plane to be equal to or slightly lower than the uppermost plane of the recording medium 101.

Instead of the flexible film 50, the inclination plate 33 may be used in the inkjet recording apparatus 10 according to the third embodiment in FIGS. 9 and 10. Thus, the inclination-plate height adjuster 35 (see FIGS. 5 and 6) and the flexible-film stretcher 36 (see FIGS. 7 and 8) may be applied to the inkjet recording apparatus 10 according to the third embodiment in FIGS. 9 and 10.

For example, the parallel height adjuster 59 has a parallelogram shape that includes a plurality of hinge holes 44 at a plurality of positions of the stage piece 40. The plurality of positions of the stage piece 40 include two positions on a left side and a right side and two positions on a front side and a rear side in FIGS. 9 to 11. For example, the parallel height adjuster 59 further includes a plurality of hinge holes 46 at a plurality of positions of the height adjusting piece 45. The height adjusting piece 45 forms the parallel plane and supports the flexible film 50.

The plurality of hinge holes 46 is used for adjusting the height of the parallel plane of the height adjusting piece 45. The plurality of positions of the height adjusting piece 45 include two positions on a left side and a right side and two positions on a front side and a rear side in FIGS. 9 to 11.

Figure 11:
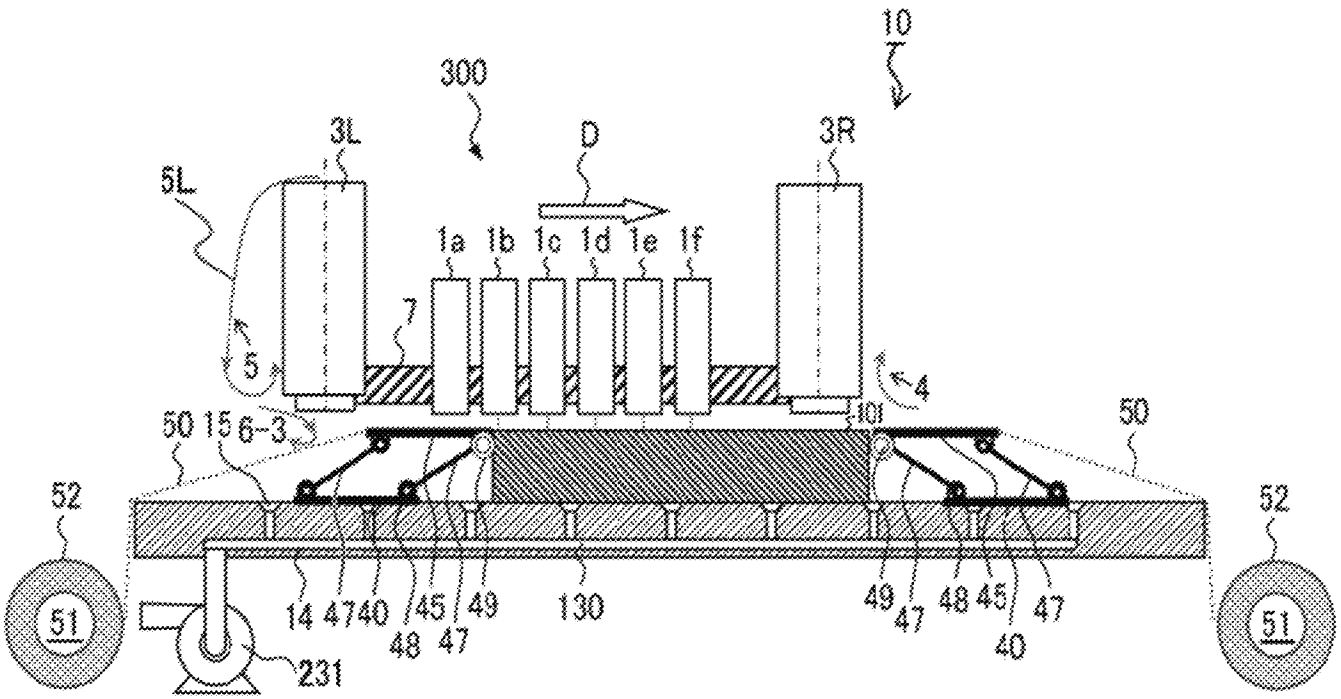
FIG. 11 is a schematic cross-sectional front view of the inkjet recording apparatus of UV ink type according to a fourth embodiment of the present disclosure including parallel height adjusters to reduce the turbulent airflow.

As illustrated FIGS. 9 to 11, the parallel height adjuster 59 includes two parallel-linking plates 47 having an equal length. The parallel-linking plates 47 are connected to the plurality of hinge holes 44 and 46 by parallel-linking shafts 48. The parallel-linking plates 47 connect the stage piece 40 and the height adjusting piece 45. The parallel-linking shafts 48 penetrate through the hinge holes 44 and 46 to serve as rotating shafts.

Thus, the parallel-linking plate 47 is rotatable around the parallel-linking shaft 48 so that the height adjusting piece 45 is parallelly movable with the stage piece 40 with a movement of the parallel-linking plates 47. In FIGS. 9 and 10, the parallel height adjuster 59 includes a height adjusting screw 49 attached to one of the plurality of hinge holes 46 to be tightened to fix the height of the parallel plane of the height adjusting piece 45 of the parallel height adjuster 59.

The height adjusting screw 49 can maintain an angle between the height adjusting piece 45 and the parallel-linking plate 47. Thus, a parallel plane (upper surface) of the flexible film 50 (height adjusting piece 45) can be parallel to a plane (upper surface) of the stage 130. Thus, the height of the flexible film 50 (height adjusting piece 45) can be maintained to a predetermined height.

With such a structure illustrated in FIGS. 9 to 11, the parallel plane (area) of the flexible film 50 (height adjusting piece 45) is formed such that the height of the plane of the flexible film 50 (height adjusting piece 45) is substantially the same as the height of the upper surface of the recording medium 101 or slightly lower than the height of the upper surface of the recording medium 101. The parallel plane (area) of the flexible film 50 is smaller than an area (plane) of each the inclination-plate height adjuster 35 (see FIGS. 5 and 6) and the flexible-film stretcher 36 (see FIGS. 7 and 8).

Thus, a closed space surrounded by the height adjusting piece 45, the left end (rear end) of the recording medium 101, the flexible film 50, and a bottom surface of the carriage 7 is formed. The closed space is away from the recording medium 101. Thus, a region in which the ink mist or the turbulent airflow 6-3 is occurred is formed at a position away from the region in which the printing operation is performed. Thus, the inkjet recording apparatus 10 can improve the image quality.

FIG. 11 illustrates the inkjet recording apparatus 10 according to a fourth embodiment that includes the parallel height adjusters 59 on both sides (left side and right side) of the recording medium 101. The flexible-film stretcher 36 is used in the inkjet recording apparatus 10 according to the fourth embodiment. It is more preferable that the parallel height adjusters 59 are provided at the left and right sides and front and rear sides of the recording medium 101.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions. For example, the controller 137 (unit control circuit 131) as described above may be implemented by one or more processing circuits or circuitry.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge method comprising:

placing a recording medium on a stage;

discharging a liquid onto the recording medium on the stage;

providing an inclined wall adjacent to the recording medium, the inclined wall configured to cover a part of the stage; and adjusting a height of one end of the inclined wall to be equal to or lower than a thickness of the recording medium.

2. The liquid discharge method according to claim 1, wherein the inclined wall includes an inclination plate, and one end of the inclination plate is adjacent to an end surface of the recording medium, and another end of the inclination plate is in contact with the stage.

3. The liquid discharge method according to claim 2, wherein the adjusting the height of one end of the inclined wall to be equal to or lower than the thickness of the recording medium comprises:

supporting the inclination plate at a position adjacent to the recording medium by a support piece of a height adjuster;

fixing the support piece on the stage by a stage piece of the height adjuster; and variably adjusting an angle between the support piece and the stage piece by an angle adjusting hinge of the height adjuster.

4. The liquid discharge method according to claim 3, wherein the inclination plate includes a parallel plane parallel to an upper surface of the recording medium, and a height of the parallel plane of the inclination plate is adjusted to be equal to or lower than the thickness of the recording medium by a parallel height adjuster of the height adjuster.

5. The liquid discharge method according to claim 2, wherein the inclination plate comprises a material including a plurality of pores.

6. The liquid discharge method according to claim 2, wherein the inclination plate comprises a material having repellency to the liquid.

7. The liquid discharge method according to claim 1, further includes:

winding the inclined wall by a winder, wherein the inclined wall includes a flexible film, and one end of the flexible film is adjacent to an end surface of the recording medium, and another end of the flexible film is wound by the winder.

8. The liquid discharge method according to claim 7, wherein the flexible film comprises a material including a plurality of pores.

9. The liquid discharge method according to claim 7, wherein the flexible film comprises a material having repellency to the liquid.

10. The liquid discharge method according to claim 7, wherein the flexible film includes a parallel plane parallel to an upper surface of the recording medium, and a height of the parallel plane of the flexible film is adjusted to be equal to or lower than the thickness of the recording medium by a parallel height adjuster of the height adjuster.

11. An inclination wall for a liquid discharge apparatus comprising:

an inclination plate adjacent to a recording medium, onto which a liquid is to be discharged, on a stage, the inclined plate configured to cover a part of the stage;

wherein a height of one end of the inclined plate is adjusted to be equal to or lower than a thickness of the recording medium.

12. The inclination wall according to claim 11, wherein one end of the inclination plate is adjacent to an end surface of the recording medium, and another end of the inclination plate is in contact with the stage.

13. The inclination wall according to claim 11, wherein the inclination plate comprises a material including a plurality of pores.

14. The inclination wall according to claim 11, wherein the inclination plate comprises a material having repellency to the liquid.

15. The inclination wall according to claim 11, wherein the inclination plate includes a parallel plane parallel to an upper surface of the recording medium, and a height of the parallel plane of the inclination plate is adjusted to be equal to or lower than the thickness of the recording medium by a parallel height adjuster of a height adjuster.

16. The inclination wall according to claim 11, wherein the inclined plate includes a flexible film, and one end of the flexible film is adjacent to an end surface of the recording medium, and another end of the flexible film is wound by a winder.

17. The liquid discharge method according to claim 16, wherein the flexible film comprises a material including a plurality of pores.

18. The liquid discharge method according to claim 16, wherein the flexible film comprises a material having repellency to the liquid.

19. The liquid discharge method according to claim 16, wherein the flexible film includes a parallel plane parallel to an upper surface of the recording medium, and a height of the parallel plane of the flexible film is adjusted to be equal to or lower than the thickness of the recording medium by a parallel height adjuster of a height adjuster.

* * * * *